US007467967B2

(12) United States Patent
Kuo

(10) Patent No.: US 7,467,967 B2
(45) Date of Patent: Dec. 23, 2008

(54) CABLE ASSEMBLY WITH IMPROVED STRESS RELIEF

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,145

(22) Filed: Aug. 20, 2007

(65) Prior Publication Data

US 2008/0045073 A1 Feb. 21, 2008

(51) Int. Cl.
*H01R 13/58* (2006.01)

(52) U.S. Cl. ..... 439/449

(58) Field of Classification Search ..... 439/610, 439/449, 607–609, 470, 465, 675
See application file for complete search history.

(56) References Cited

U.S. PATENT DOCUMENTS

| | | | | |
|---|---|---|---|---|
| 4,634,208 | A * | 1/1987 | Hall et al. | 439/610 |
| 5,759,069 | A * | 6/1998 | Kitatani et al. | 439/675 |
| 5,954,542 | A * | 9/1999 | Wu et al. | 439/610 |
| 6,431,904 | B1 | 8/2002 | Berelsman | |
| 6,616,477 | B1 * | 9/2003 | Chang | 439/465 |

* cited by examiner

*Primary Examiner*—Jean F Duverne
(74) *Attorney, Agent, or Firm*—Wei Te Chung

(57) ABSTRACT

A cable assembly includes a main cable, at least one sub-cable extending from the main cable, a stress relief formed of a first insulative material integrally molded with a joint of the main cable and said at least one sub-cable and a cover formed of a second insulative material attached to and surrounding the stress relief, wherein the first insulative material is softer than the second insulative material.

11 Claims, 4 Drawing Sheets

CABLE ASSEMBLY WITH IMPROVED STRESS RELIEF

BACKGROUND OF THE INVENTION

1. Field of the Invention

The present invention relates generally to a cable assembly, and particularly to such a cable assembly including a stress relief.

2. Description of Related Arts

The purpose of network and telecommunication cables is to carry data or signals from one device to another. As telecommunication and related electronic networks and systems advance to meet the ever-increasing needs of the modern world, the cables flare out into sub-cables to attach to their own destinations. Practice has shown that a significant loss/distortion of the data or signal occurs at areas with a highest stress, for example, a joint between the cables and the sub-cables, due to flexing, tension or torsional twisting. One method to avoid a highest stress on the cables is that the joint of the cables has been coated with a plastic or thermoset insulating material, which is called a stress relief. However, the stress relief is made of flexible and soft material, so, it can't endure a destroying from exterior.

Hence, a cable assembly with an improved stress relief is desired.

SUMMARY OF THE INVENTION

Accordingly, an object of the present invention is to provide a cable assembly with a cover formed of a hard material, for assembling to a stress relief formed of a soft material, and providing a sheath.

Another object of the present invention is to provide a cable assembly whose stress relief is strong enough to prevent the destroying from exterior.

To achieve the above objects, a cable assembly comprises: a main cable, at least one sub-cable extending from the main cable, a stress relief formed of a first insulative material integrally molded with a joint of the main cable and said at least one sub-cable and a cover formed of a second insulative material attached to and surrounding the stress relief, wherein the first insulative material is softer than the second insulative material.

Other objects, advantages and novel features of the invention will become more apparent from the following detailed description when taken in conjunction with the accompanying drawings.

DETAILED DESCRIPTION OF THE PREFERRED EMBODIMENT

Figure 1:
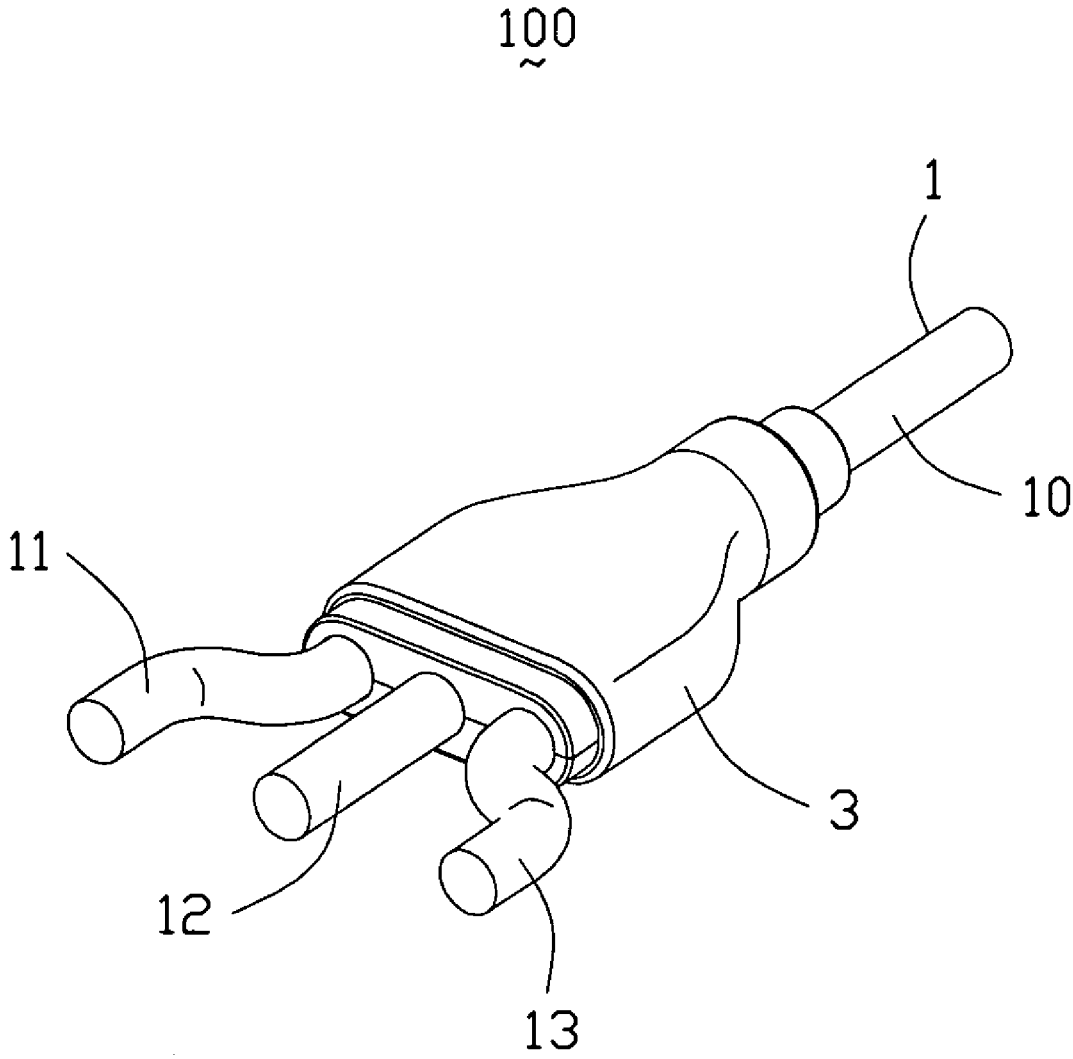
FIG. 1 is a perspective, assembled view of a cable assembly in accordance with the present invention.
Figure 2:
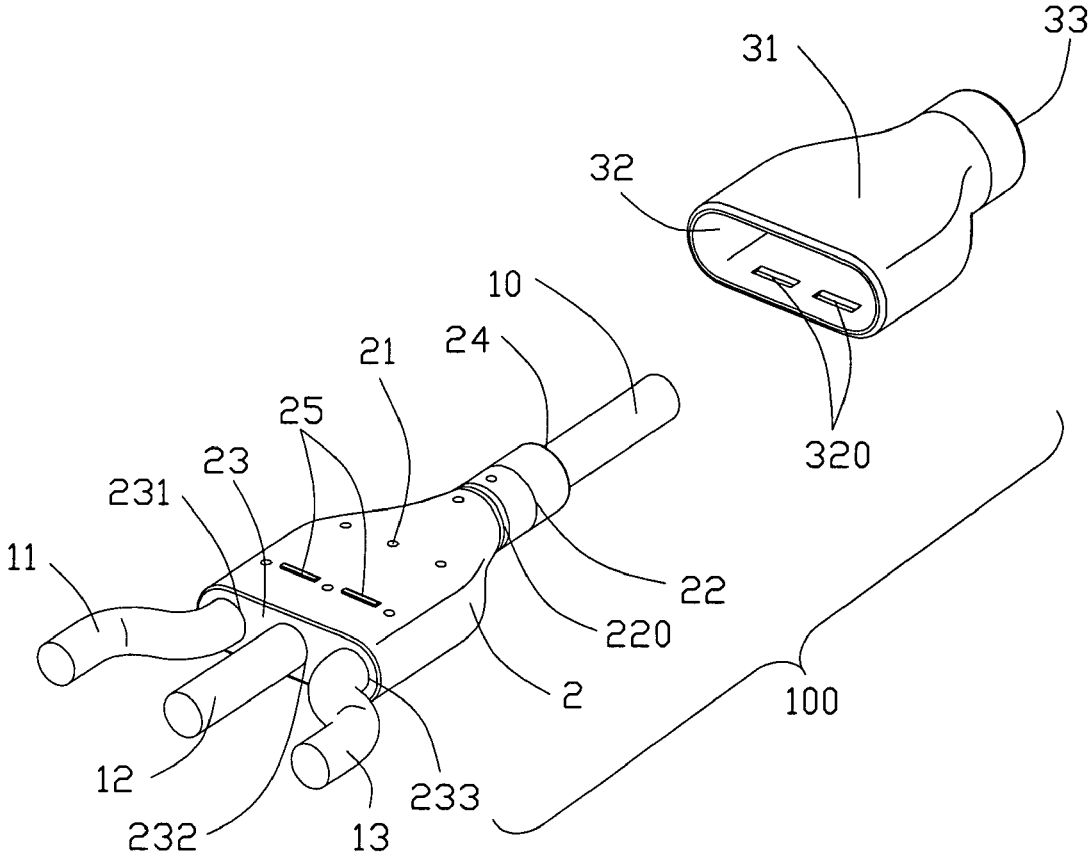
FIG. 2 is a perspective, partly exploded view of the cable assembly.
Figure 3:
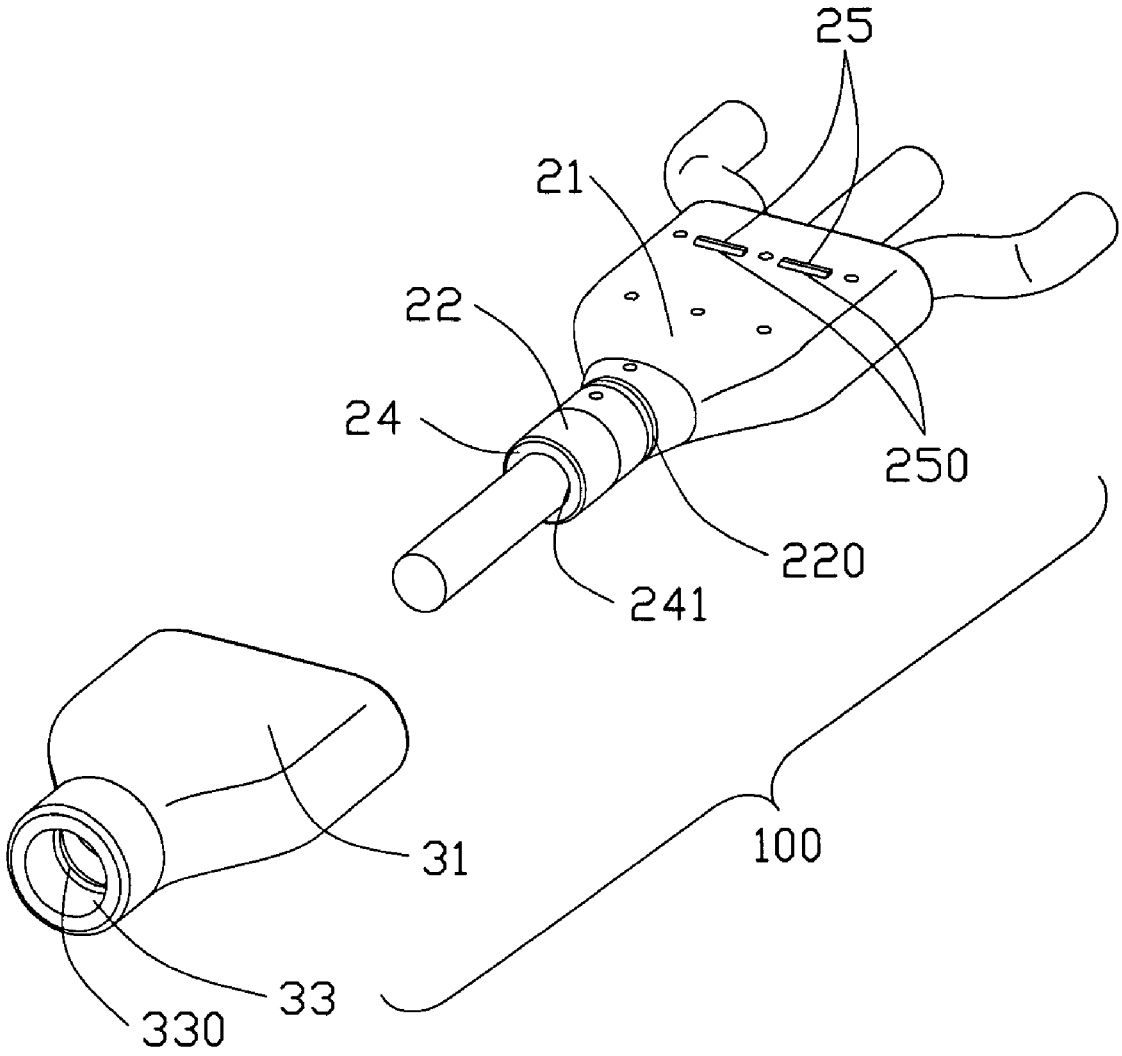
FIG. 3 is a view similar to FIG. 2, but taken from a different aspect.

Referring to FIGS. 1-3, a cable assembly 100 comprises a cable 1, a stress relief 2 to protect the cable 1 and a cover 3 to protect the stress relief 2. The cable 1 comprises a main cable 10 and three sub-cables 11, 12, 13 extending from the main cable 10. The stress relief 2 is molded on the linking point of the main cable 10 and the three sub-cables 11, 12, 13. In this embodiment, the stress relief 2 is made of a softer material than the cover 3. The stress relief 2 comprises a main portion 21 and a rear portion 22. A plurality of protrudings 25 is formed on an outer surface (no labeled) of the main portion 21 and a circular slot 220 is formed around the rear portion 22. Such protrudings 25 include guiding surfaces 250, which make the cover 3 and the stress relief 2 easy to cooperate. The main portion 21 comprises a first receiving channel 231, a second receiving channel 232, and a third receiving channel 233, and the rear portion 22 comprises a main receiving channel 241, and further more, all the receiving channels 231, 232, 233 and 241 communicate with each other in the inner of the stress relief 2. The sub-cables 11, 12, 13 are separately received in the corresponding receiving channels 231, 232, 233 and extending out of a forward surface 23 of the main portion 21. Similarly, the main cable 10 is received in the main receiving channel 241 and extending out of a backward surface 24 of the rear portion 22. Both the forward surface 23 and the backward surface 24 are erect to the direction defining by the main portion 21 and the rear portion 22. The cover 3, molded beforehand, is made of rigid material, so that its outer surface 31 can endure a destroying force from the exterior. The cover 3 forms a front receiving room 32 and a back receiving room 33. A plurality of grooves 320 is formed on an inner surface (not labeled) of the front receiving room 32 mating with the protrudings 25. The back receiving room 33 comprises a circular protrusive rib 330 mating with the circular slot 220. So, the cover 3 is steadily covering over the stress relief 2.

In this embodiment, the three sub-cables 11, 12, 13 are in a same plane and extends along a direction defining by the main cable 10; in other embodiment, the three sub-cables 11, 12, 13 are in three-dimensional relations and they are parallel to each other along a direction defining by the main cable 10.

Figure 4:
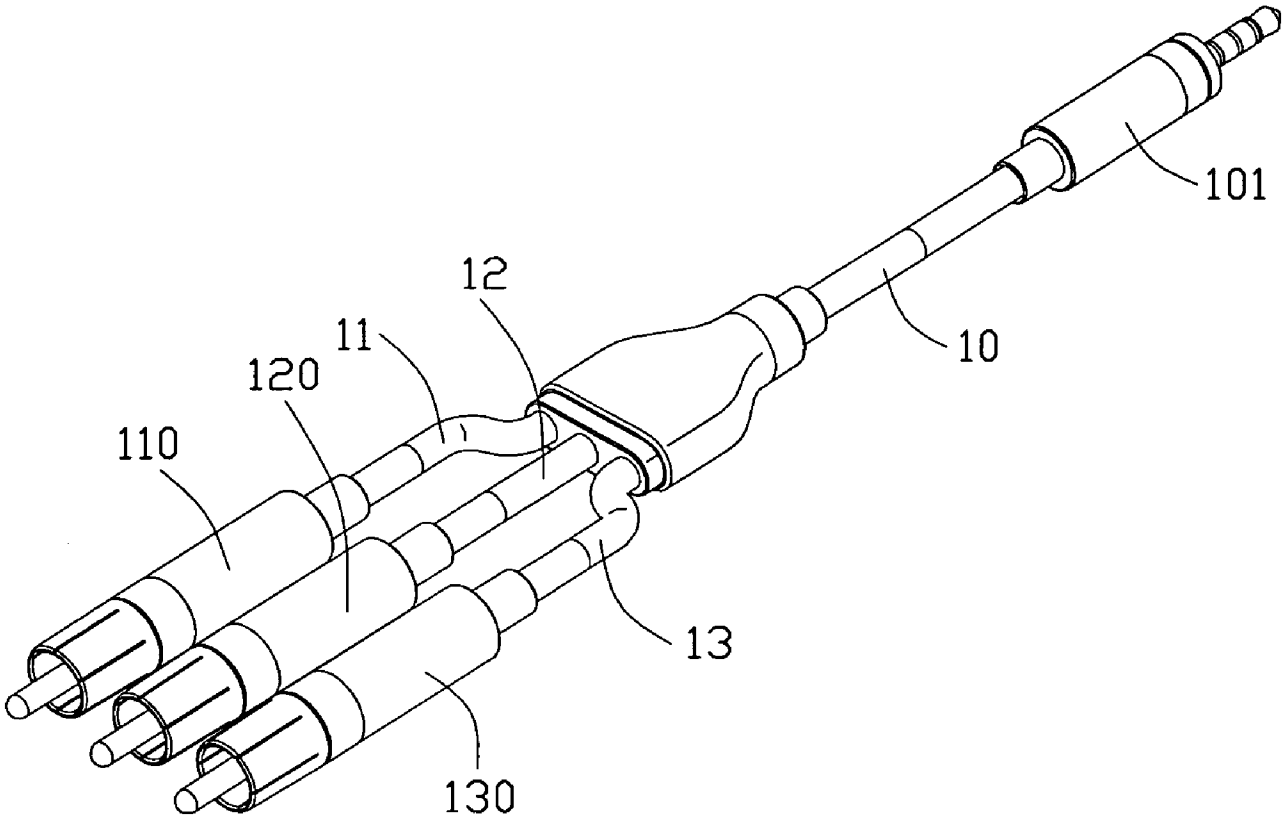
FIG. 4 is a view of a connection between the cable assembly and the corresponding plugs.

Referring to FIG. 4, the main cable 10 is connected with an audio-plug 101, while the three sub-cables 11, 12, 13 are correspondingly connected with three lotiform plugs 110, 120, 130. Signals can travel through the audio-plug 101, the main cable 10, the three sub-cables 11, 12, 13 and the three lotiform plugs 110, 120, 130 in turn, to attach the corresponding destinations.

The stress relief 2 of the cable assembly 100, made of flexible material, such as plastic, is used for protecting the main cable 10 and the sub-cables 11, 12, 13 and the linking point between them, so that it can endure a high hauling and distorting force and the signals traveling in the cables can be successfully transmitted. For the cover 3 covering the stress relief 2 is made of hard material, it can prevent the flexible stress relief 2 from being destroyed by the exterior.

While a preferred embodiment in accordance with the present invention has been shown and described, equivalent modifications and changes known to persons skilled in the art according to the spirit of the present invention are considered within the scope of the present invention as described in the appended claims.

I claim:

1. A cable assembly, comprising:

a main cable;

at least one sub-cable extending from the main cable;

a stress relief formed of a first insulative material integrally molded with a joint of the main cable and said at least one sub-cable; and a cover formed of a second insulative material attached to and surrounding the stress relief;

wherein the first insulative material is softer than the second insulative material; wherein at least one sub-cable comprises at least three sub-cables forking from a distal end of the main cable, and parts of the sub-cables which is molded in the stress relief is in a same plane; wherein at least three receiving channels receiving said at least three sub-cables and a main receiving channel receiving the main cable communicate with each other in the inner of the stress relief.

2. The cable assembly as described in claim 1, wherein the cover molded beforehand attaches firmly to the stress relief by some locking portions thereof.

3. The cable assembly as described in claim 1, wherein one of the stress relief and the cover forms a protrusion and the other forms a recess snugly receiving said protrusion.

4. The cable assembly as described in claim 3, wherein the protrusion is formed on the stress relief, and the recess is formed in the cover.

5. The cable assembly as described in claim 3, wherein both of said protrusion and said recess extends in a transverse direction.

6. A cable assembly, comprising:

a main cable extending along a first direction;

at least three sub-cables terminated to one distal end of the main cable, each of said sub-cables extending along a second direction opposite to the first direction;

a stress relief integrally molded on the joints of the main cable and said at least three sub-cables so as to intimately fully circumferentially contact and hold each of said main cable and said at least three sub-cables in position; and an insulative cover assembled to and intimately surrounding the stress relief for providing a sheath;

wherein said three sub-cables are arranged parallel to one another along a third direction perpendicular to both said first direction and said second direction; wherein at least three receiving channels receiving said at least three sub-cables and a main receiving channel receiving the main cable communicate with each other in the inner of the stress relief.

7. The cable assembly as described in claim 6, wherein an insulative material of the stress relief is softer than that of the cover.

8. The cable assembly as described in claim 6, wherein one of the stress relief and the cover forms a protrusion and the other forms a recess snugly receiving said protrusion.

9. The cable assembly as described in claim 8, wherein the protrusion is formed on the stress relief, and the recess is fanned in the cover.

10. The cable assembly as described in claim 8, wherein both of said protrusion and said recess extends in a transverse direction.

11. The cable assembly as claimed in claim 6, wherein all said sub-cables are arranged at a same level with one another so as to lessen a thickness of said strain relief.

* * * * *